US006152766A

United States Patent [19]

Wu et al.

[11] Patent Number: 6,152,766

[45] Date of Patent: Nov. 28, 2000

[54] ELECTRICAL CONNECTOR

[75] Inventors: Jerry Wu, Chang-Hua; Allen Chiu, Taipei, both of Taiwan

[73] Assignee: Hon Hai Precision Ind. Co., Ltd., Taipei Hsien, Taiwan

[21] Appl. No.: 09/379,541

[22] Filed: Aug. 23, 1999

[30] Foreign Application Priority Data

Oct. 13, 1998 [TW] Taiwan ..... 87216906

[51] Int. Cl.[7] ..... H01R 13/73

[52] U.S. Cl. ..... 439/570

[58] Field of Search ..... 439/569–572, 439/83

[56] References Cited

U.S. PATENT DOCUMENTS 5,171,165 12/1992 Hwang ..... 439/571
5,186,654 2/1993 Enomoto et al. ..... 439/570
5,879,187 3/1999 Cheng et al. ..... 439/570
5,893,764 4/1999 Long ..... 439/570

*Primary Examiner*—Gary F. Paumen
*Attorney, Agent, or Firm*—Wei Te Chung

[57] ABSTRACT

An electrical connector of the present invention comprises an elongate insulative housing, a number of terminals received in the housing and a pair of retention devices assembled in opposite ends of the housing. Each retention device comprises a U-shaped body having a pair of parallel mounting tabs and an elongate engaging portion extending from an edge of the body. The engaging portion forms a number of projections on opposite sides thereof for interferentially engaging with an inner periphery of a passage of the housing whereby the mounting faces of the retention devices lie in the same plane as mounting faces of the terminals.

4 Claims, 5 Drawing Sheets

ELECTRICAL CONNECTOR

BACKGROUND OF THE INVENTION

The present invention relates to a connector, and particularly to a connector having a retention device mounted to a circuit board by surface mounting technology (SMT).

Connector assemblies are often mounted to a circuit board by through hole technology or SMT. Regardless of the method used, terminals of each connector are mounted to the circuit board by solder balls. Due to the high density of the terminals, the solder balls are very small which results in a fragile connection between the terminals and holes/circuit pads of the circuit board whereby an external force exerted on the connector can not be resisted. Thus, connectors often have a retention device to sustain an external force exerted thereon and retain the connector on the circuit board. Such connectors are disclosed in U.S. Pat. Nos. 5,145,405; 5,133,679; and 5,259,789.

However, an engaging portion of the conventional retention device is short whereby the retention force between the engaging portion and a housing is too low to provide a secure connection. In addition, the retention device does not provide an effective guiding means for accurately fixing the retention device to the housing. Thus, coplanarity between mounting portions of the retention device and mounting portions of terminals is difficult to attain. Furthermore, the retention device is not suitable for mass production. Hence, an improved electrical connector is required to overcome the disadvantages of the prior art.

BRIEF SUMMARY OF THE INVENTION

A first object of the present invention is to provide a connector having a retention device with an elongate engaging portion for securely and accurately engaging a connector housing.

A second object of the present invention is to provide a retention device that can be mass produced.

Accordingly, an electrical connector of the present invention comprises an elongate insulative housing, a plurality of terminals received in the housing and a pair of retention devices assembled in opposite ends of the housing. Each retention device comprises a U-shaped body having a pair of parallel mounting tabs and an elongate engaging portion extending from an edge of the body. The engaging portion forms a plurality of projections on opposite sides thereof for interferentially engaging with an inner periphery of a passage of the housing whereby the mounting faces of the retention devices lie in the same plane as mounting faces of the terminals.

Other objects, advantages and novel features of the invention will become more apparent from the following detailed description of the present embodiment when taken in conjunction with the accompanying drawings.

DETAILED DESCRIPTION OF THE INVENTION

Figure 1:
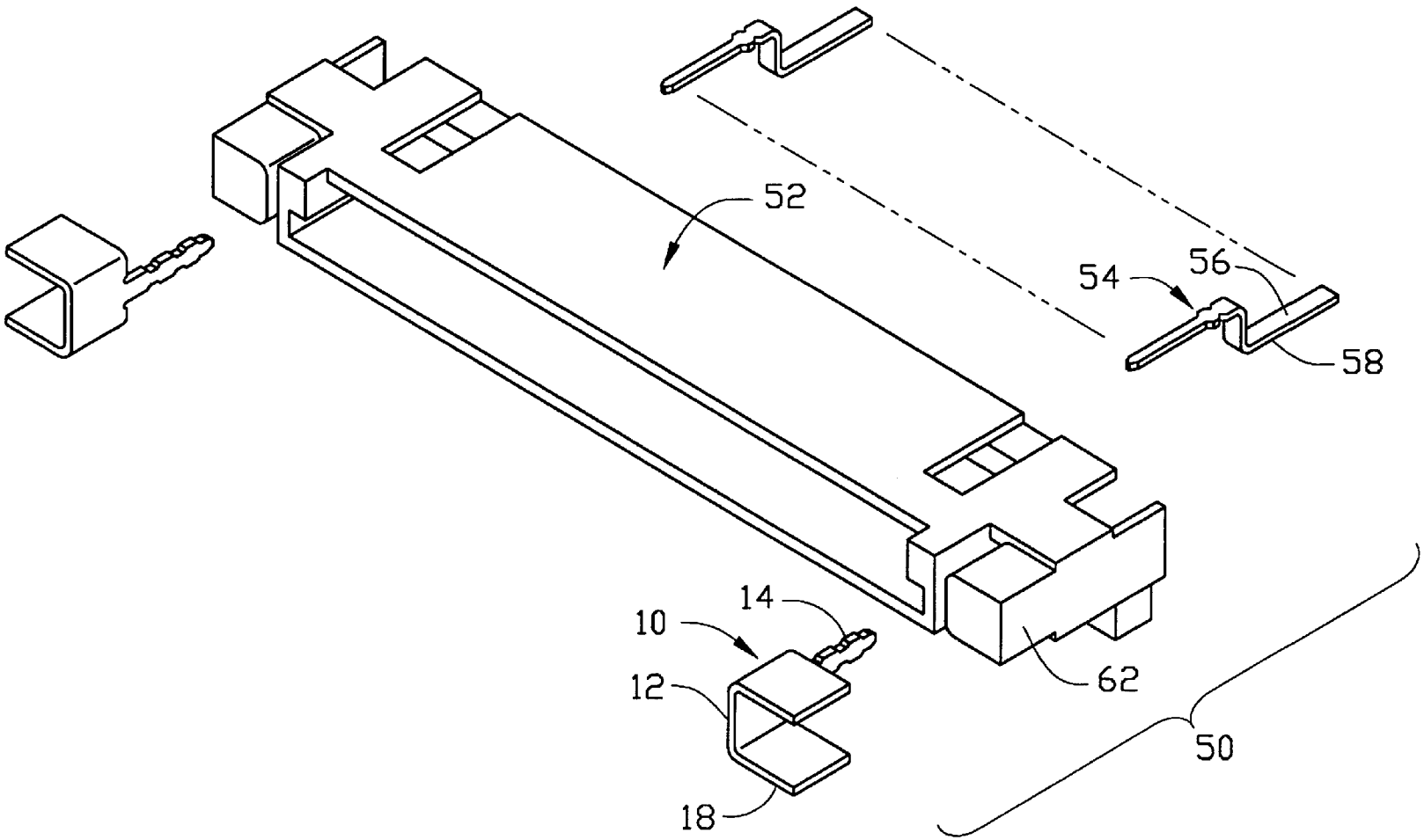
FIG. 1 is an exploded view of an electrical connector of the present invention.
Figure 2:
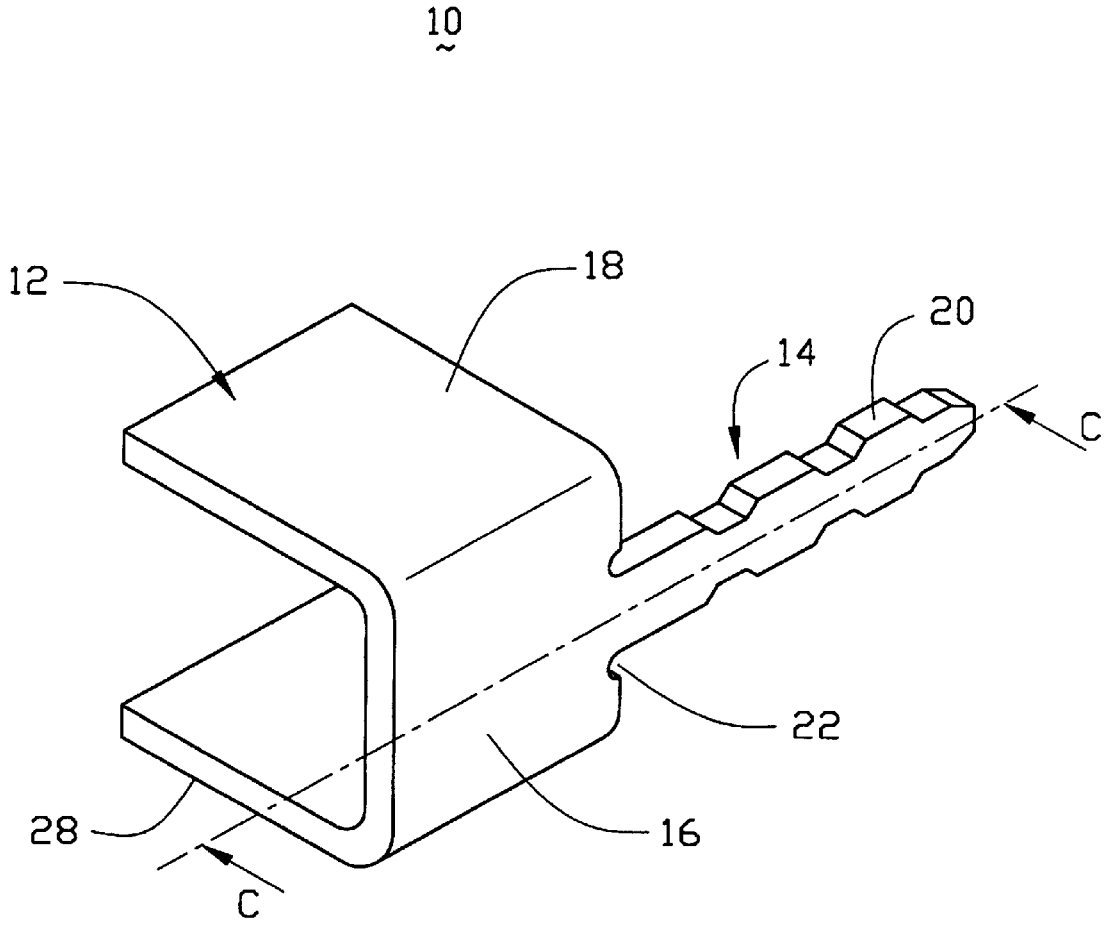
FIG. 2 is a perspective view of a retention device of the present invention.
Figure 4:
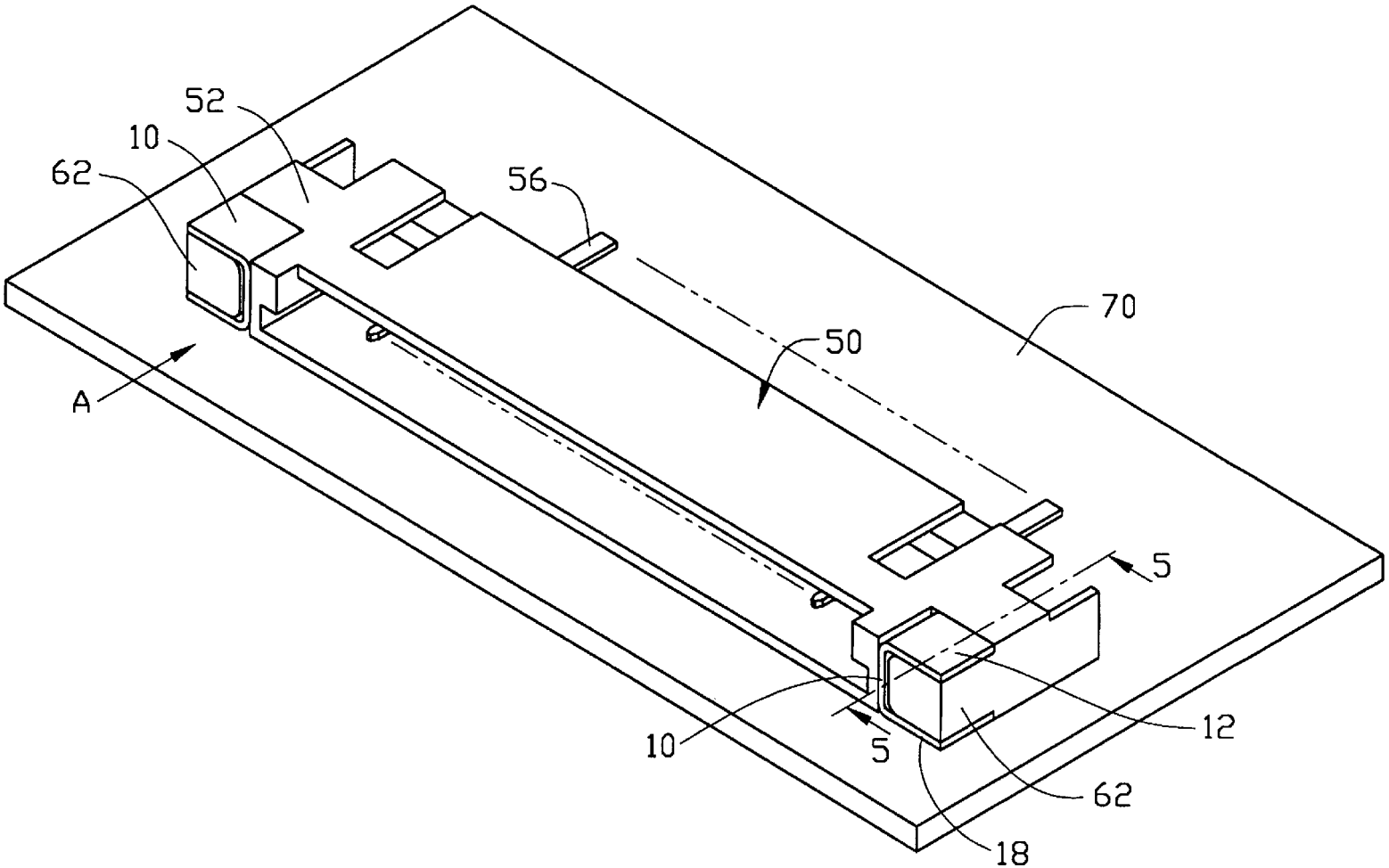
FIG. 4 is a perspective view of the electrical connector mounted to a circuit board.

Referring to FIGS. 1 and 2, an electrical connector 50 of the present invention comprises an elongate insulative housing 52, a plurality of terminals 54 received in the housing 52 and a pair of retention devices 10 assembled in opposite ends of the housing 52. Each terminal 54 has a mounting portion 56 and a mounting face 58 for being mounted to a circuit board 70 (FIG. 4). Each retention device 10 comprises a U-shaped body 12 and an elongate engaging portion 14 extending from an edge thereof. The body 12 is bent to form a rectangular base 16 and a pair of parallel mounting tabs 18 extending from opposite edges of the base 16 in the same direction, one mounting tab 18 for being mounted to the circuit board 70 using SMT. The engaging portion 14 forms a plurality of projections 20 on opposite sides thereof for securely retaining the retention device 10 in the housing 52 (described in detail later). A pair of cutouts 22 is formed in the body 12 where the engaging portion 14 extends from the base 16 for reducing a concentration of stress therebetween. The retention device 10 is symmetrical about a plane which includes the central line C—C (FIG. 2).

Figure 3:
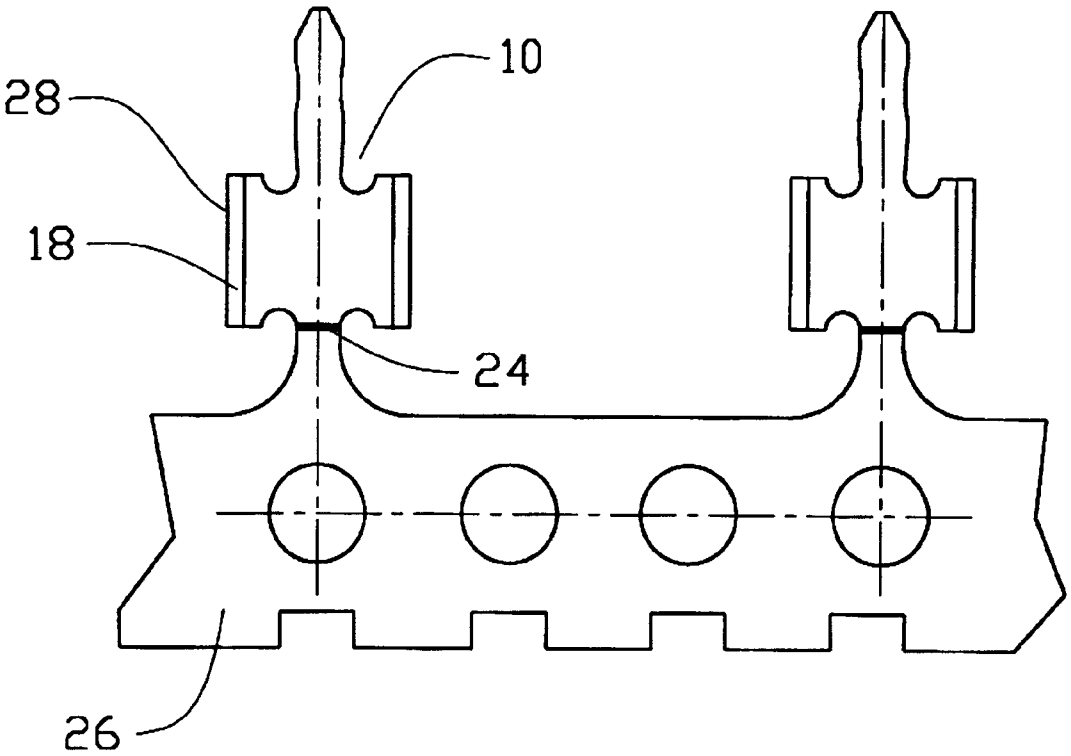
FIG. 3 is a planar view of the retention device attached to a carrier.

Referring to FIG. 3, the retention device 10 is stamped and formed from a sheet of metal material. The sheet is stamped to form an initial planar shape, and a pair of notches 24 is formed at a position where the retention device 10 extends from a carrier 26. Opposite ends of the body 12 are perpendicularly bent in the same direction to form the mounting tabs 18. The retention device 10 is then plated to form a coating having excellent conductive characteristics on a mounting surface 28 of the mounting tabs 18. The retention devices 10 are then separated from the carrier 26 where the notches 24 are formed.

Figure 5:
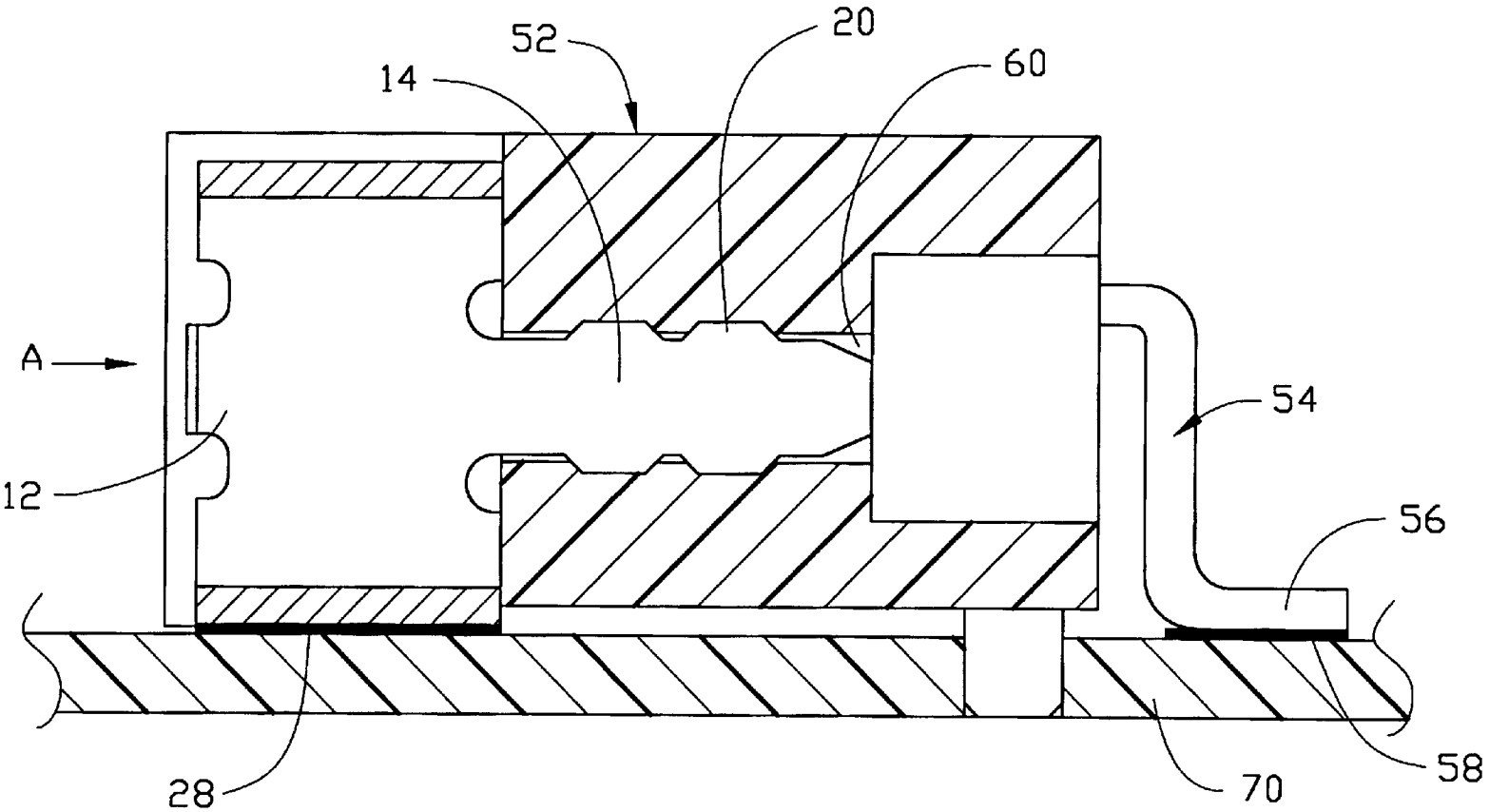
FIG. 5 is a cross-sectional view taken along line 5—5 of FIG. 4.

Referring to FIGS. 4 and 5, the retention device 10 is engaged with the housing 52 in the direction of arrow A. The engaging portion 14 is received in a corresponding passage 60 of the housing 52. The projections 20 interferentially engage with an inner periphery of the passage 60 to secure the retention device 10 in the housing 52. The U-shaped body 12 tightly surrounds an extending portion 62 of the housing 52.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounted to a circuit board comprising:

an insulative housing;

a plurality of conductive terminals received in the housing; and a retention device assembled in the housing, the one-piece retention device having a base, an engaging portion extending from an edge of the base and a pair of mounting tabs extending from opposite edges of the base, one mounting tab being soldered to the circuit board, the engaging portion lying in the same plane as the base, the one mounting tab having a mounting surface lying in the same plane as mounting faces of the terminals;

wherein the engaging portion forms a plurality of projections on opposite sides thereof;

wherein the mounting tabs extend perpendicularly from the base;

wherein the retention device is symmetrical about a plane extending through the engaging portion and parallel to the mounting tabs.

2. The electrical connector as claimed in claim 1, wherein the retention device defines a smooth cutout at a position where the engaging portion extends from the base for reducing a concentration of stress thereat.

3. A one-piece retention device for securing an electrical connector to a circuit board, the retention device comprising:

a base;

an engaging portion extending from one edge of the base; and a pair of mounting tabs extending from opposite edges of the base, one mounting tab being soldered onto the circuit board;

wherein the engaging portion lies in the same plane as the base, and said one mounting tab has a mounting surface lying in the same plane as a mounting face of the circuit board;

wherein the engaging portion forms a plurality of projections on opposite sides thereof;

wherein the mounting tabs extend perpendicularly from the base;

wherein the retention device is symmetrical about a plane extending through the engaging portion and parallel to the mounting tabs.

4. The retention device as claimed in claim 3 further comprising a smooth cutout defined at a position where the engaging portion extends from the base for reducing a concentration of stress thereat.

* * * * *